US010393459B2

(12) United States Patent
Tompkins

(10) Patent No.: US 10,393,459 B2
(45) Date of Patent: Aug. 27, 2019

(54) MODULAR RECEIVER SYSTEM FOR FIREARMS AND AN ADJUSTABLE AND TOOL-LESS REMOVABLE TRIGGER ASSEMBLY

(71) Applicant: Edward Tompkins, Brunswick, GA (US)

(72) Inventor: Edward Tompkins, Brunswick, GA (US)

( * ) Notice: Subject to any disclaimer, the term of this patent is extended or adjusted under 35 U.S.C. 154(b) by 0 days.

(21) Appl. No.: 15/724,593

(22) Filed: Oct. 4, 2017

(65) Prior Publication Data

US 2018/0100712 A1 Apr. 12, 2018

Related U.S. Application Data

(60) Provisional application No. 62/404,050, filed on Oct. 4, 2016.

(51) Int. Cl.

| | |
|---|---|
| ***F41A 19/15*** | (2006.01) |
| ***F41A 19/10*** | (2006.01) |
| ***F41A 3/66*** | (2006.01) |
| ***F41A 11/00*** | (2006.01) |
| *F41A 17/46* | (2006.01) |
| *F41A 11/02* | (2006.01) |

(52) U.S. Cl.

CPC ..... *F41A 19/10* (2013.01); *F41A 3/66* (2013.01); *F41A 11/00* (2013.01); *F41A 19/15* (2013.01); *F41A 11/02* (2013.01); *F41A 17/46* (2013.01)

(58) Field of Classification Search

CPC .. F41A 3/66; F41A 11/00; F41A 11/02; F41A 19/15; F41A 19/10; F41A 17/46

USPC ..... 42/75.01, 69.01, 69.03

See application file for complete search history.

(56) References Cited

U.S. PATENT DOCUMENTS

| | | | | |
|---|---|---|---|---|
| 8,789,305 | B1 * | 7/2014 | DiChario | F41A 3/66 42/75.03 |
| 9,046,313 | B1 * | 6/2015 | Lutton | F41A 17/46 |
| 2011/0167696 | A1 * | 7/2011 | Gangl | F41A 17/46 42/69.03 |
| 2016/0153744 | A1 * | 6/2016 | Teetzel | F41C 27/06 42/105 |
| 2016/0187091 | A1 * | 6/2016 | Moretti | F41A 19/10 42/69.01 |
| 2016/0187092 | A1 * | 6/2016 | Mather | F41A 19/10 42/69.02 |
| 2016/0282075 | A1 * | 9/2016 | Colman | F41A 19/15 |

FOREIGN PATENT DOCUMENTS

TW 409847 * 10/2000

* cited by examiner

*Primary Examiner* — John Cooper

(74) *Attorney, Agent, or Firm* — Bennet K. Langlotz; Langlotz Patent & Trademark Works, LLC

(57) ABSTRACT

A firearm comprising a frame defining a trigger assembly receptacle between opposed sidewalls. A trigger assembly received in the trigger assembly receptacle and including pivot pins, with the sidewalls defining pin apertures adapted to receive pivot pins. The pin apertures being oversized with respect to standard pin apertures. The trigger assembly having a pivoting safety selector and having a safety selector detent adapted to engage the safety selector in a stable rotational position. The sidewalls defining a safety selector aperture adapted to receive the safety selector. The safety selector aperture being oversized with respect to standard safety selector apertures, such that the frame is incompatible with standard trigger assemblies.

1 Claim, 15 Drawing Sheets

FIG. 4D
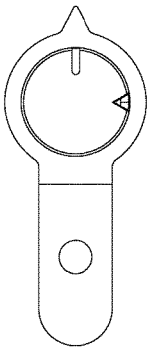
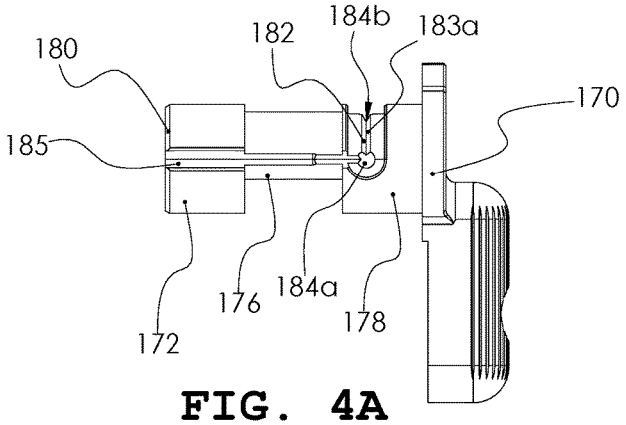
FIG. 4A
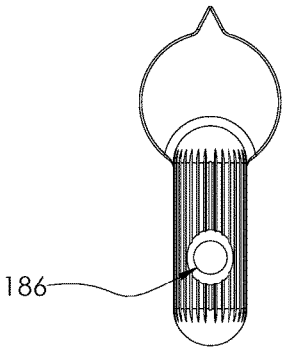
FIG. 4E
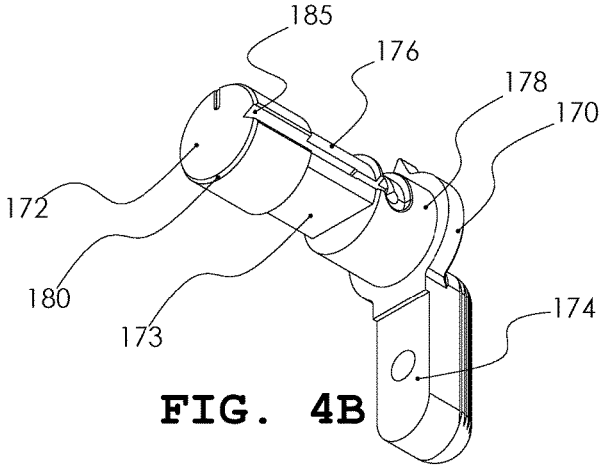
FIG. 4B
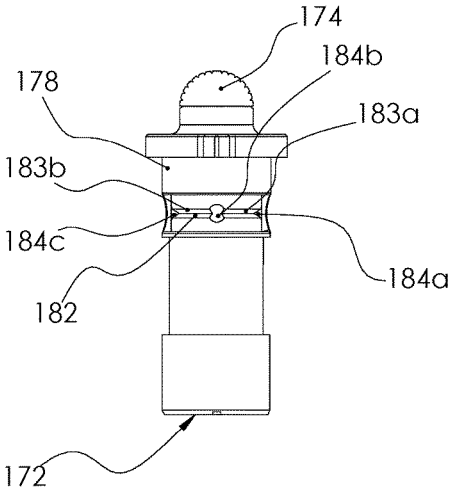
FIG. 4C
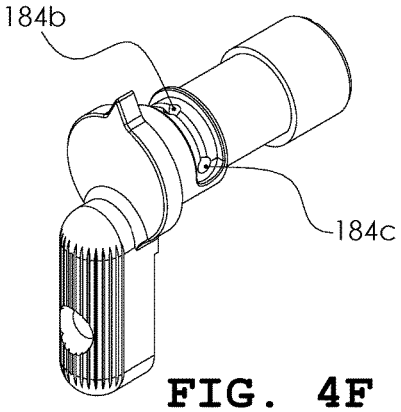
FIG. 4F

MODULAR RECEIVER SYSTEM FOR FIREARMS AND AN ADJUSTABLE AND TOOL-LESS REMOVABLE TRIGGER ASSEMBLY

CROSS-REFERENCE TO RELATED APPLICATION

This application claims the benefit of U.S. Provisional Patent Application No. 62/404,050 filed on Oct. 4, 2016, entitled "MODULAR RECEIVER SYSTEM FOR FIREARMS AND AN ADJUSTABLE TRIGGER," which is hereby incorporated by reference in its entirety for all that is taught and disclosed therein.

FIELD OF THE INVENTION

The present invention relates to firearms, and more particularly to a trigger assembly.

SUMMARY OF THE INVENTION

A firearm comprising a frame defining a trigger assembly receptacle between opposed sidewalls. A trigger assembly received in the trigger assembly receptacle and including pivot pins, with the sidewalls defining with integral notches that only accept the unique trigger assembly receptacle, rendering other standard trigger assemblies incompatible. The body of the trigger assembly receptacle has a proud notch features that make it incompatible with standard frame or lower receivers. The body of the firearm's frame or lower receiver does not accept standard Trigger Pivot pins, as those pin holes do not exist in the lower and are integrally part of the trigger assembly, and are shorter than standard. The trigger assembly having a rotatable safety selector, with a range of 180 degrees, and having two safety selector with spring loaded detent assemblies adapted to engage the safety selector in a stable rotational position and prevent unintentional "release" of the safety selector, and is completely removable without tools once the "release" position is engaged. The sidewalls defining a safety selector aperture adapted to receive the safety selector, as well as the aperture in the body of the trigger assembly receptacle.

BRIEF DESCRIPTION OF THE DRAWINGS

FIGS. 4A-4F are isolated views of the safety selector.

DESCRIPTION OF THE CURRENT EMBODIMENT

Figure 1A:
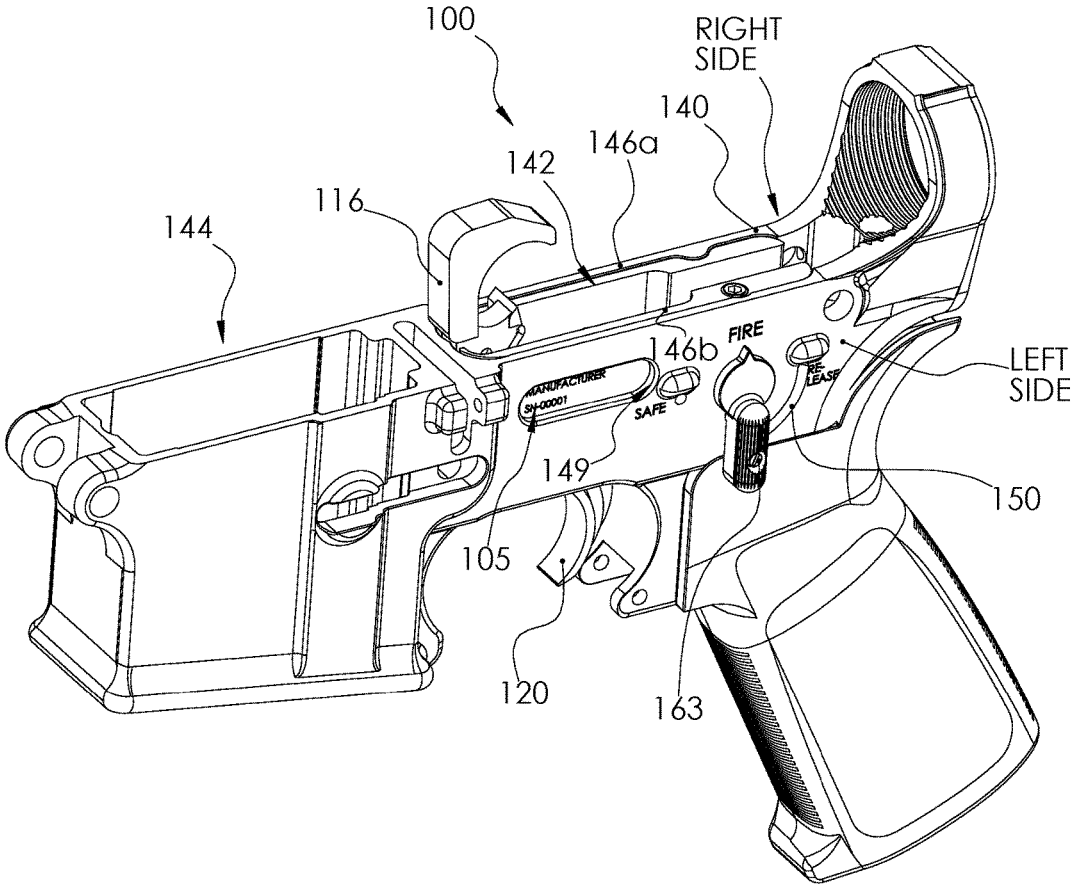
FIG. 1A is a Left Side view of the frame or lower receiver and respective trigger assembly.
Figure 1B:
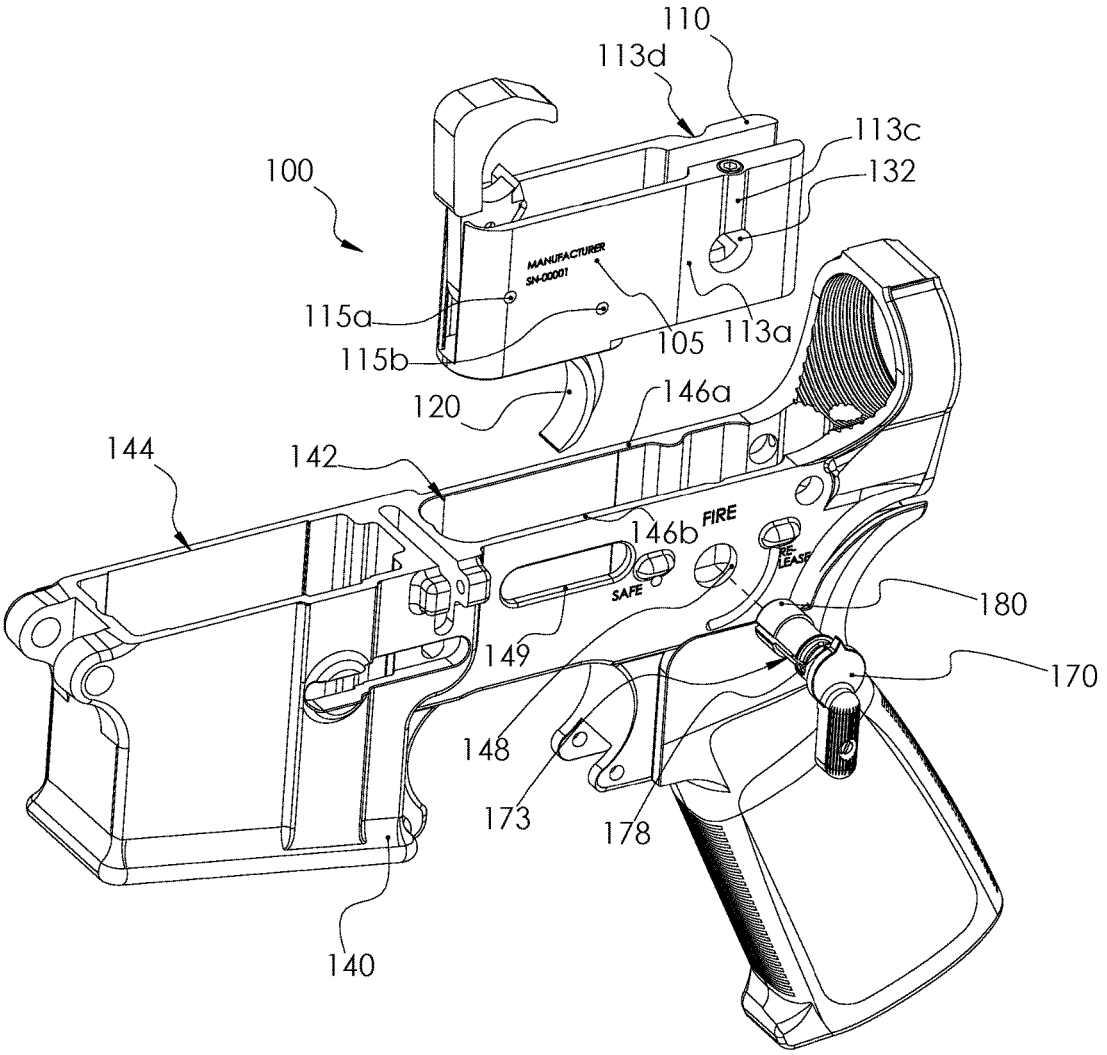
FIG. 1B is an "exploded view" of the of the frame, selector switch and the trigger assembly.
Figure 1C:
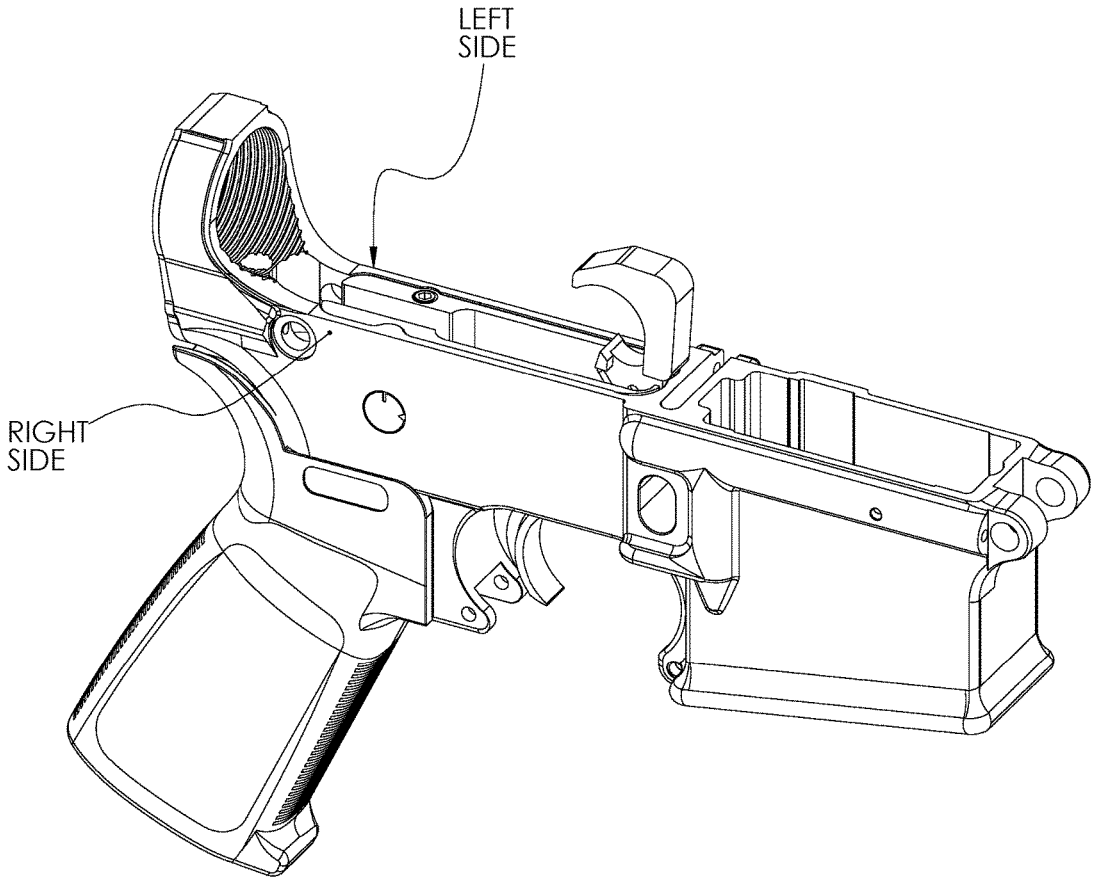
FIG. 1C is a Right Side view of the frame and trigger assembly.
Figure 1D:
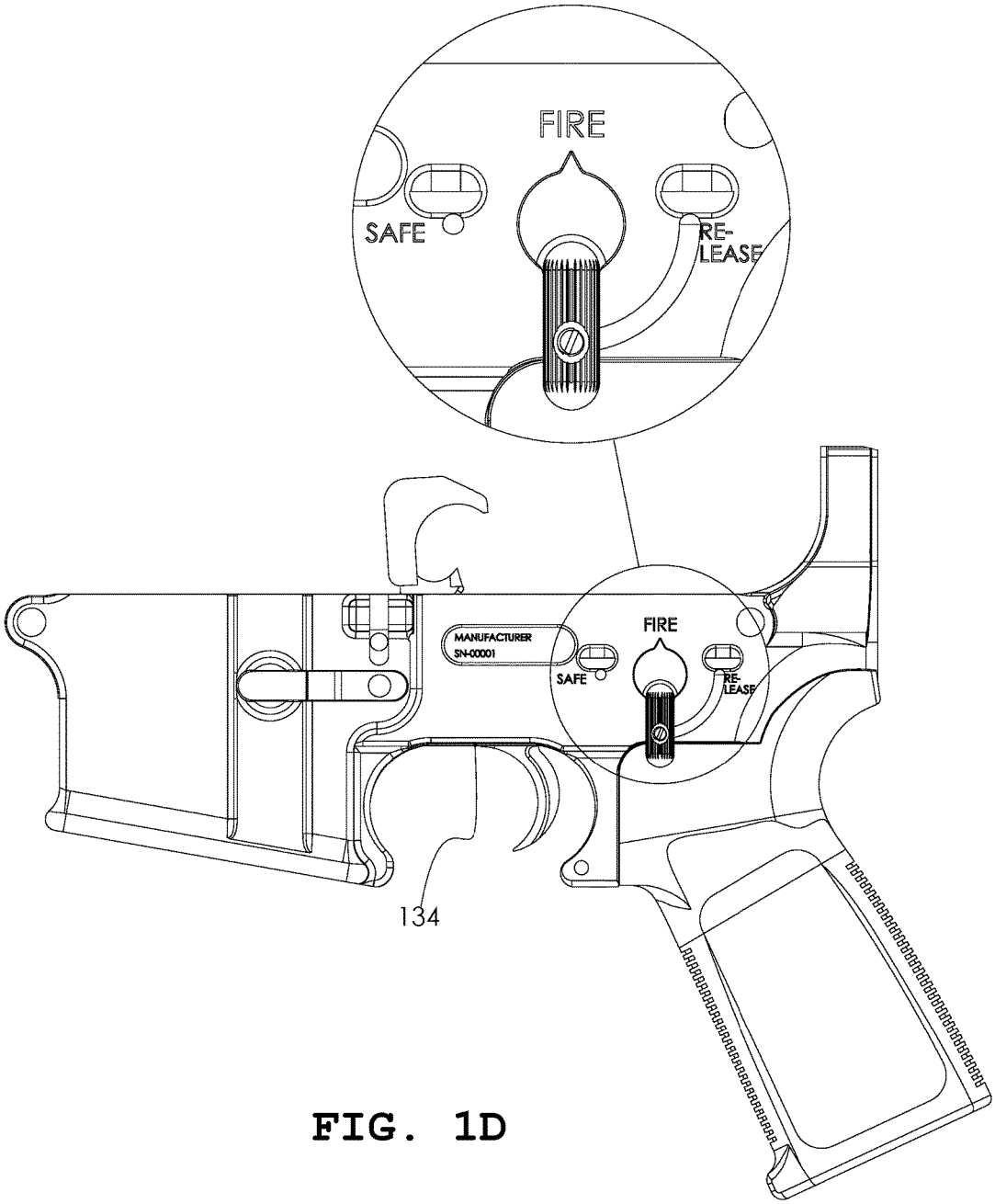
FIG. 1D is a Left Side view of the frame and respective trigger assembly.
Figure 1E:
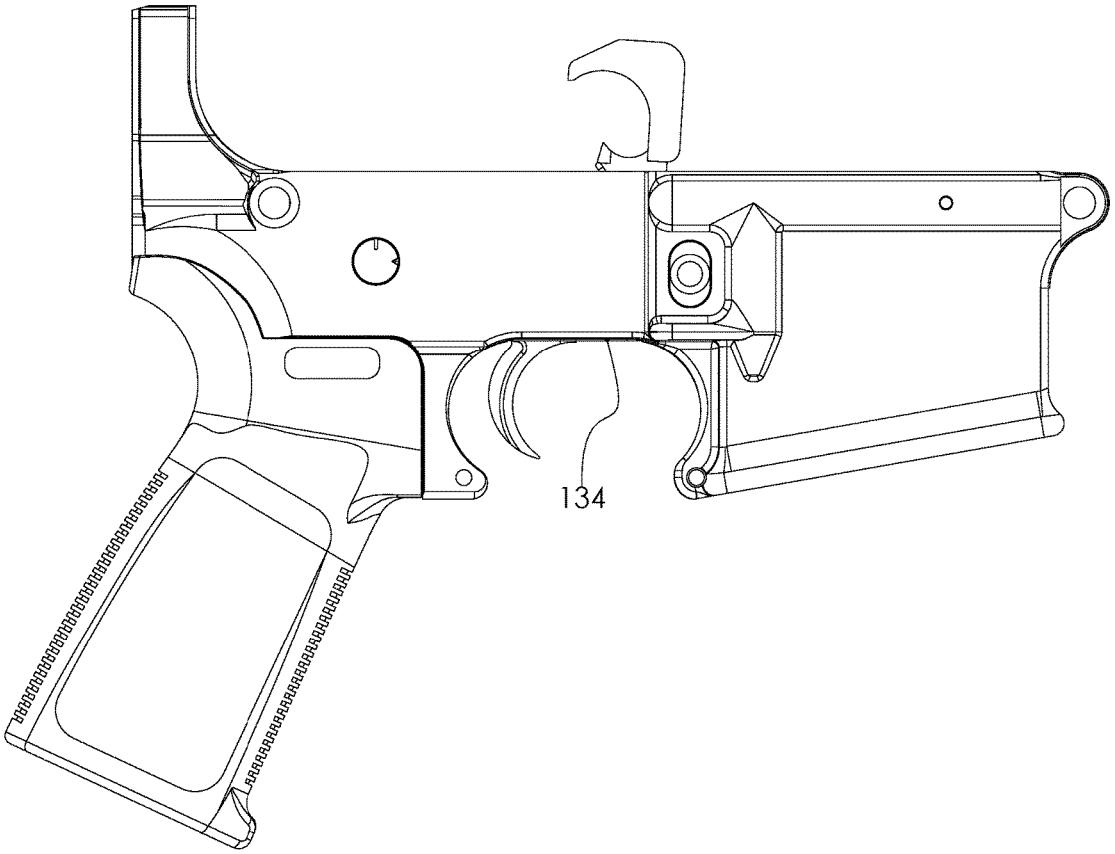
FIG. 1E is a Right Side view of the frame and trigger assembly.
Figure 1F:
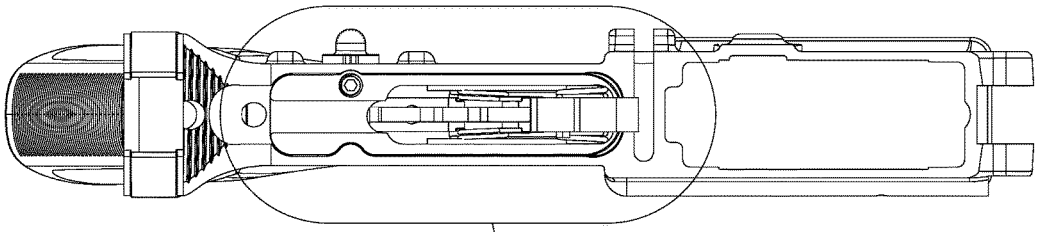
FIGS. 1F & 1G are Top Side views of the frame and trigger assembly.

FIGS. 1A and 1B illustrate an example modular receiver system 100. In some implementations, the modular receiver system 100 may be used in conjunction with an upper receiver group for an AR-15® or AR-15 type rifle to form a complete firearm, but may not be used with the lower frame or receiver group of an AR-15® or AR-15 type rifle As shown in FIGS. 1A and 1B, in some implementations, the modular receiver system 100 may comprise a receiver assembly 110 that is removably secured within a frame 140 by a safety selector 170. In some implementations, interchangeable frames 140 can be used with a receiver assembly 110 to substitute a first frame 140 configured for a first type of ammunition feeding device (e.g., a magazine) for a second frame 140 configured for a second type of ammunition feeding device (e.g., a magazine or belt-fed system). In this way, the modular receiver system 100 may be configured for use as part of a pistol, a rifle, a submachine gun, and/or a belt-fed weapon system.

Figure 2A:
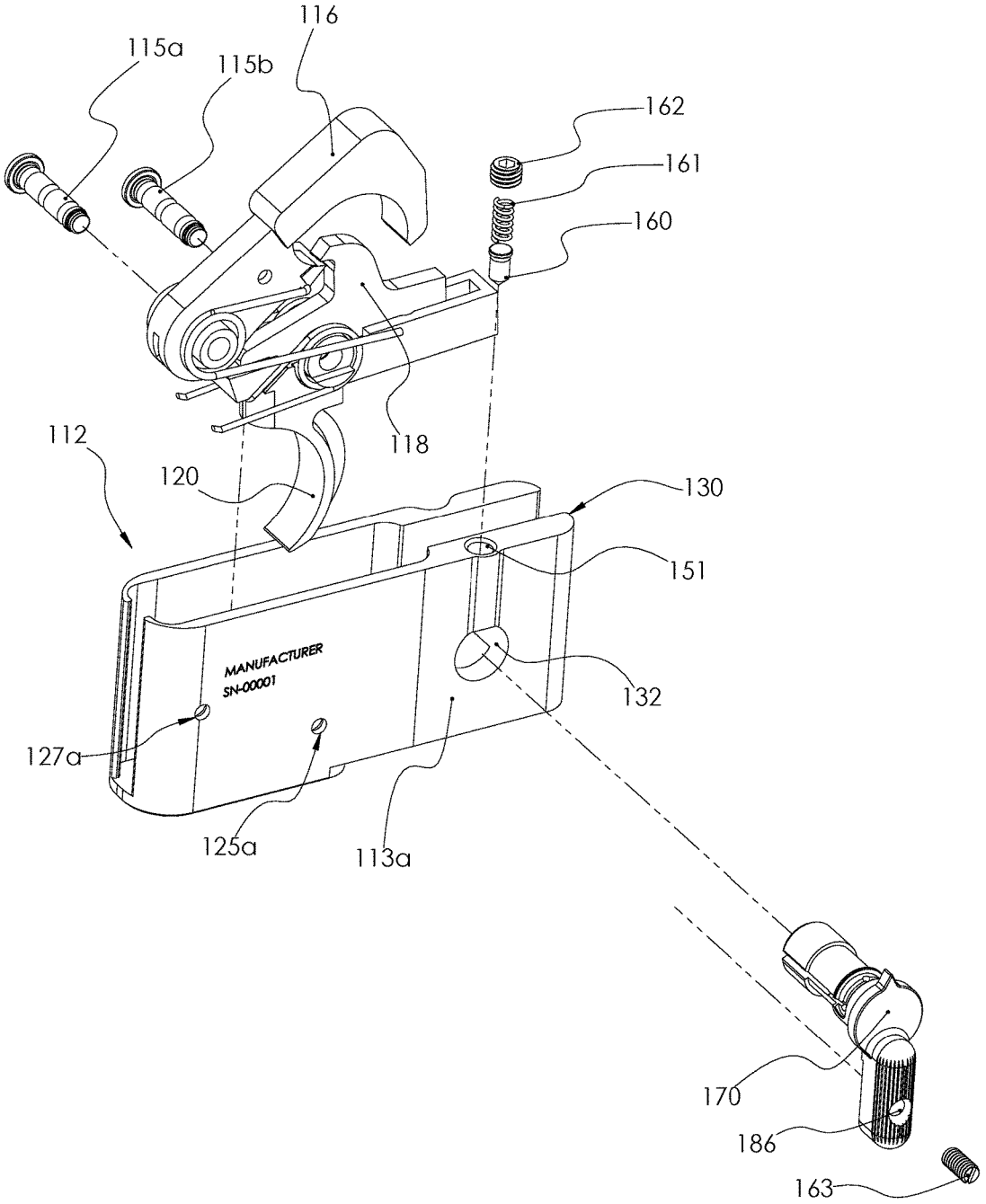
FIG. 2A is a left side "exploded view" of the trigger assembly.
Figure 2B:
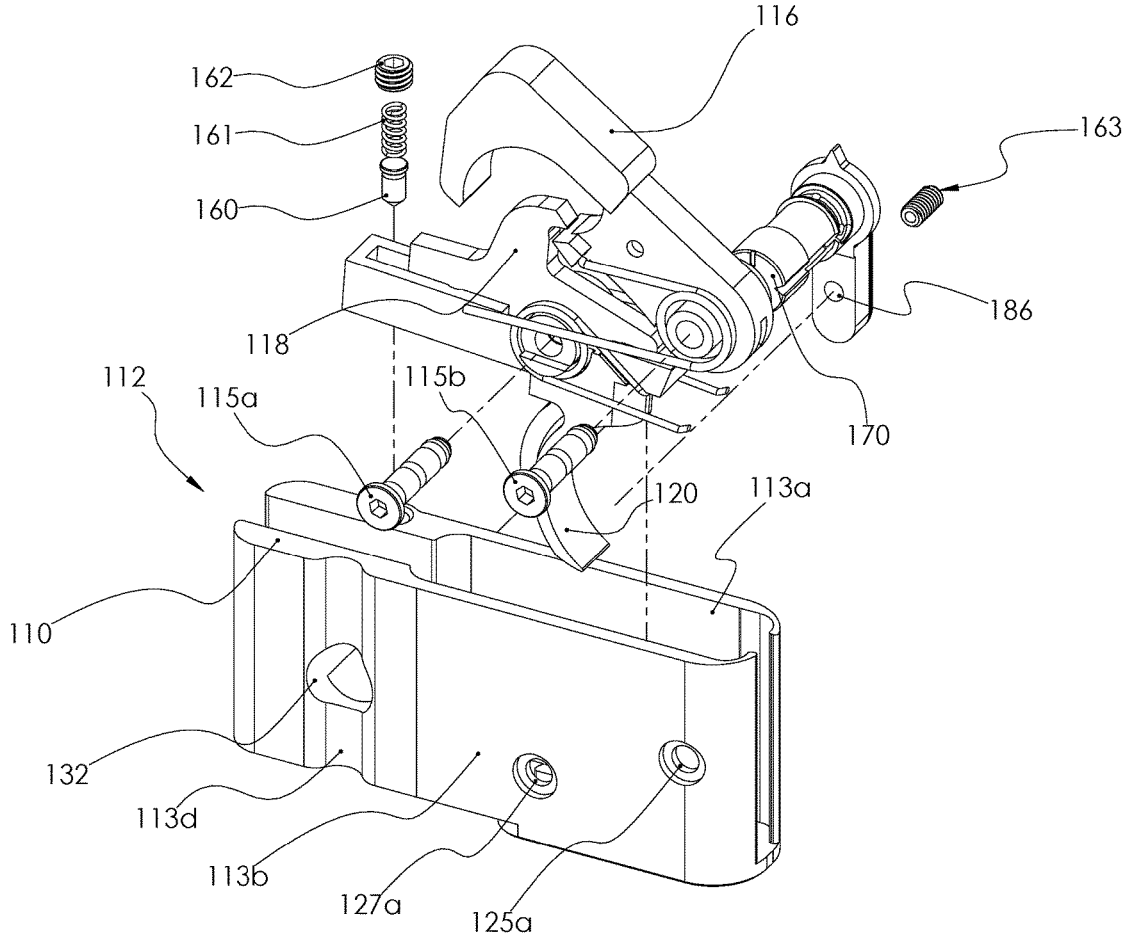
FIG. 2B is a right side "exploded view" of the trigger assembly.
Figure 3A:
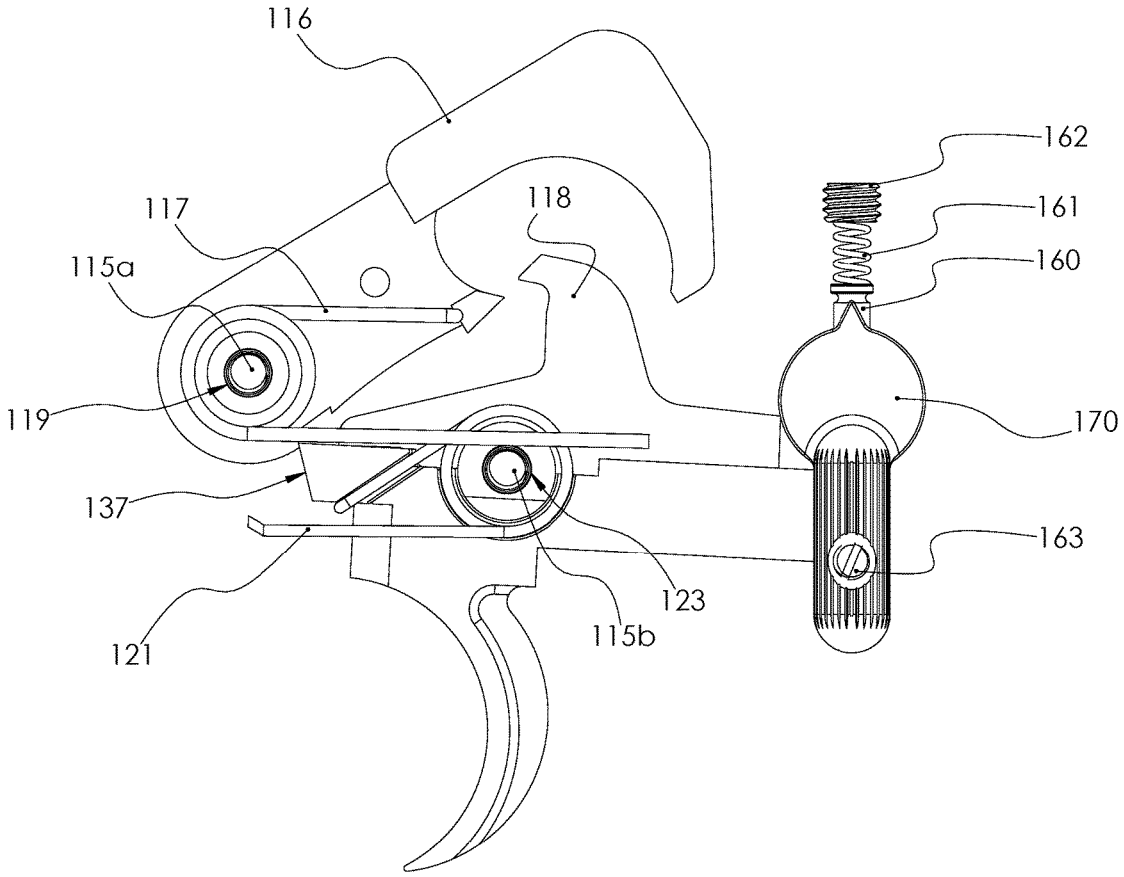
FIG. 3A is an isolated (left side) view of the fire control group and the selector switch group.
Figure 3B:
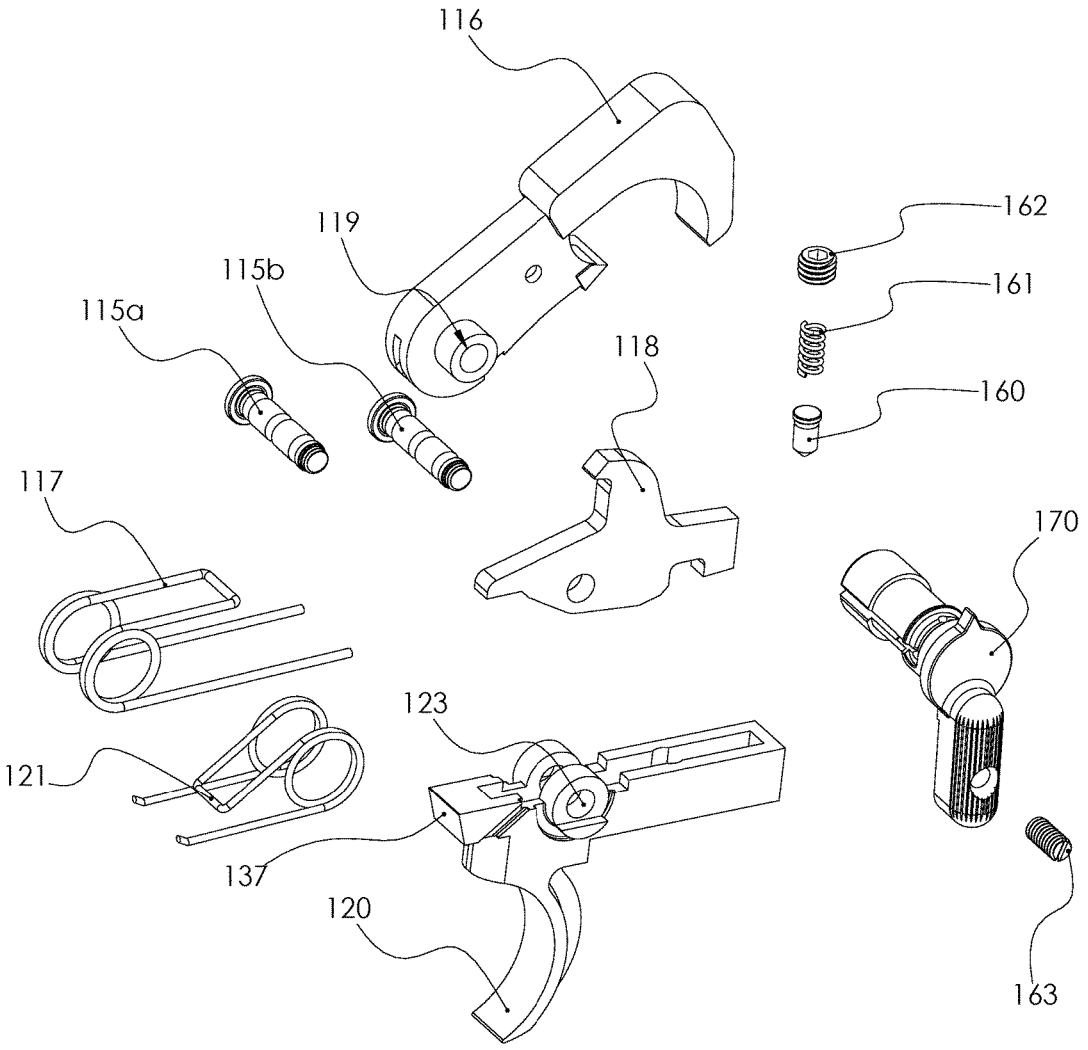
FIG. 3B is an exploded view of the fire control group and the selector switch group.

As shown in FIGS. 2A and 2B, in some implementations, the trigger receptacle assembly 110 may comprise a housing module 112 configured to contain one or more components of the fire control group, excluding the safety selector 170. In some implementations, the fire control group comprises a hammer 116, a hammer spring 117, a disconnector 118, a trigger 120, and a trigger spring 121 (see, e.g., FIGS. 3A and 3B). In some implementations, the hammer 116, the disconnector 118, and the trigger 120 are pivotally mounted within the housing module 112 (see, e.g., FIG. 2B). In some implementations, the hammer spring 117 is configured to bias the hammer 116 forward to a striking position. In some implementations, the trigger spring 121 is configured to reset the trigger 120 after it has been pulled and to provide resistance against the pulling of the trigger 120. In some implementations, the trigger 120 may be adjustable and thereby allow the user to select the pull force required to discharge a firearm. In some implementations, the trigger 120 may not be adjustable.

Those of ordinary skill in the art will recognize that the fire control group shown (e.g., the hammer 116, disconnector 118, etc.) is the same as, or similar to, the fire control group used in the firing mechanism of the COLT® model AR-15® rifle and/or other AR-15 type rifles. However, it is to be understood that the fire control group shown is only for the purposes of example and is not meant to limit the invention to the fire control group of an AR-15/M16 type rifle or to the fire control group shown in the figures.

As shown in FIGS. 2A and 2B, the housing module 112 may comprise a cavity defined between lateral side walls 113*a* and 113*b* that is large enough to house the fire control group (e.g., the hammer 116, hammer spring 117, disconnector 118, trigger 120, and trigger spring 121) and allow each of the components to move as desired to perform their respective functions. In some implementations, the components of the fire control group are held in place within the cavity of the housing module 112 by a first pin 115*a* and a second pin 115*b*. More specifically, in some implementations, the first pin 115*a* is received through a pin opening 119 of the hammer 116 and the second pin 115*b* is received through a pin opening 123 of the trigger 120 and disconnector 118 (see, e.g., FIGS. 3A and 3B).

Figure 5A:
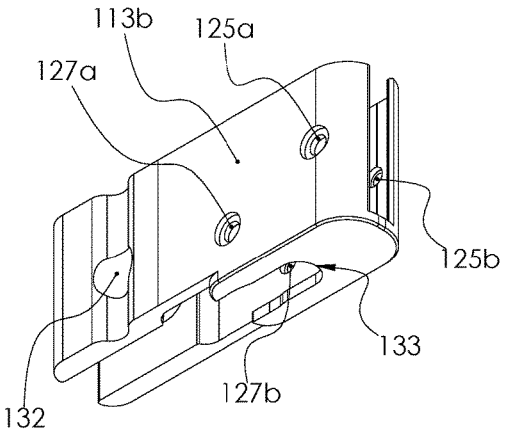
FIGS. 5A-5F are isolated views of the trigger assembly receptacle.

As shown in FIGS. 2A and 2B, in some implementations, the housing module 112 includes a first pin receiver for receiving the first pin 115*a* and supporting the first pin 115*a* by its ends. In some implementations, the first pin receiver comprises a first receiver opening 125*a* on a right lateral side wall 113*b* of the housing module 112 and a first receiver receptacle 125*b* on the opposite left lateral side wall 113*a* of the housing module 112 (see, e.g., FIG. 5A).

In some implementations, the housing module 112 includes a second pin receiver for receiving the second pin 115*b* and supporting the second pin 115*b* by its ends. In some implementations, the second pin receiver comprises a second receiver opening 127*a* on a right lateral side wall 113*b* of the housing module 112 and a second receiver receptacle 127*b* on the opposite left lateral side wall 113*a* of the housing module 112 (see, e.g., FIG. 5A).

Figure 5B:
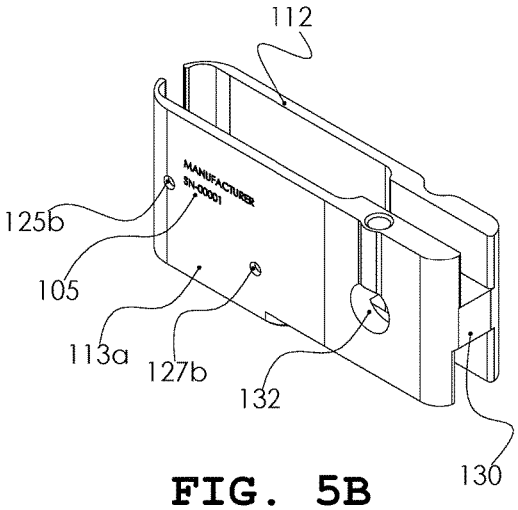
Figure 5C:
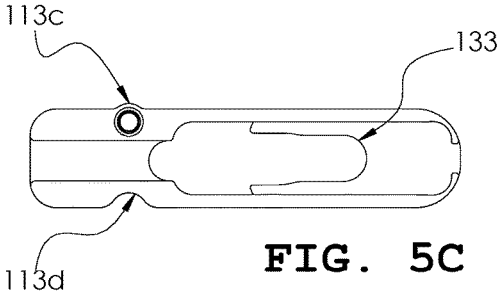
Figure 5D:
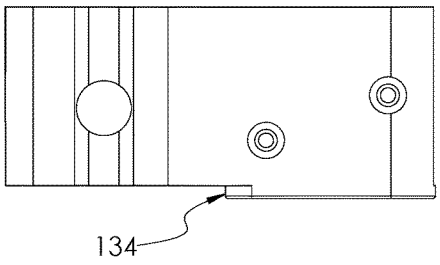
Figure 5E:
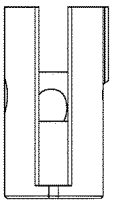
Figure 5F:
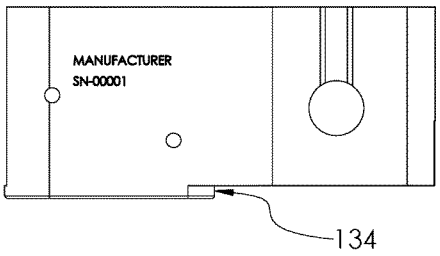

In some implementations, the first receiver receptacle 125*b* and the second receiver receptacle 127*b* on the left lateral side wall 113*a* of the housing module 112 are each an opening configured to receive and support one end of the first pin 115*a* and the second pin 115*b*, respectively, and do not extend through the left lateral side wall 113*a* (see, e.g., FIGS. 2A and 5B).

In some implementations, the first pin 115*a* is held in place by the J-spring found on the hammer 116, well known by those of ordinary skill in the art. In some implementations, the second pin 115*b* is held in place by the hammer spring 117, as would be understood by one of ordinary skill in the art.

As shown in FIGS. 2A and 2B, in some implementations, the first pin 115A, and second pin 115B, may have a hex, socket, Philips, or flat head driving feature, and threads on the opposite ends of the pins to allow the pins to be secured directly into the trigger assembly receptacle. In such a case, the trigger assembly receptacle would have corresponding threaded holes.

As shown in FIGS. 2A and 5B, in some implementations, the exterior side of the left lateral side wall 113*a* may have a serial number 105 and/or other serialized indicia thereon. In some implementations, the serial number 105 may include the name of the manufacturer and/or other identifying information (e.g., a street address).

As shown in FIGS. 1G, 2A, 5A and 5B, in some implementations, the back wall 130 of the housing module 112 extends between the back end of the lateral side walls 113*a* and 113*b* thereof. In some implementations, the back wall 130 includes a bore or groove 132 thereon that is in axial alignment with the receiving bore 148 (FIG. 1B) used to support the safety selector 170 (discussed in greater detail below). In this way, the safety selector 170 may interface with the bore or groove 132 of the housing module 112.

In some implementations, the trigger 120 is adjustable between two pull forces, the desired pull force selected being dependent open the configuration of the firearm, application (e.g., competition, hunting, etc.), and individual preference. In some implementations, the trigger 120 may be adjustable between 3.5 lbs and 5.5 lbs of pull force to initiate a discharge of a firearm. In some implementations, the trigger 120 may be configured so the pull force required to initiate a discharge is less than 3.5 lbs and/or greater than 5.5 lbs.

Figure 2C:
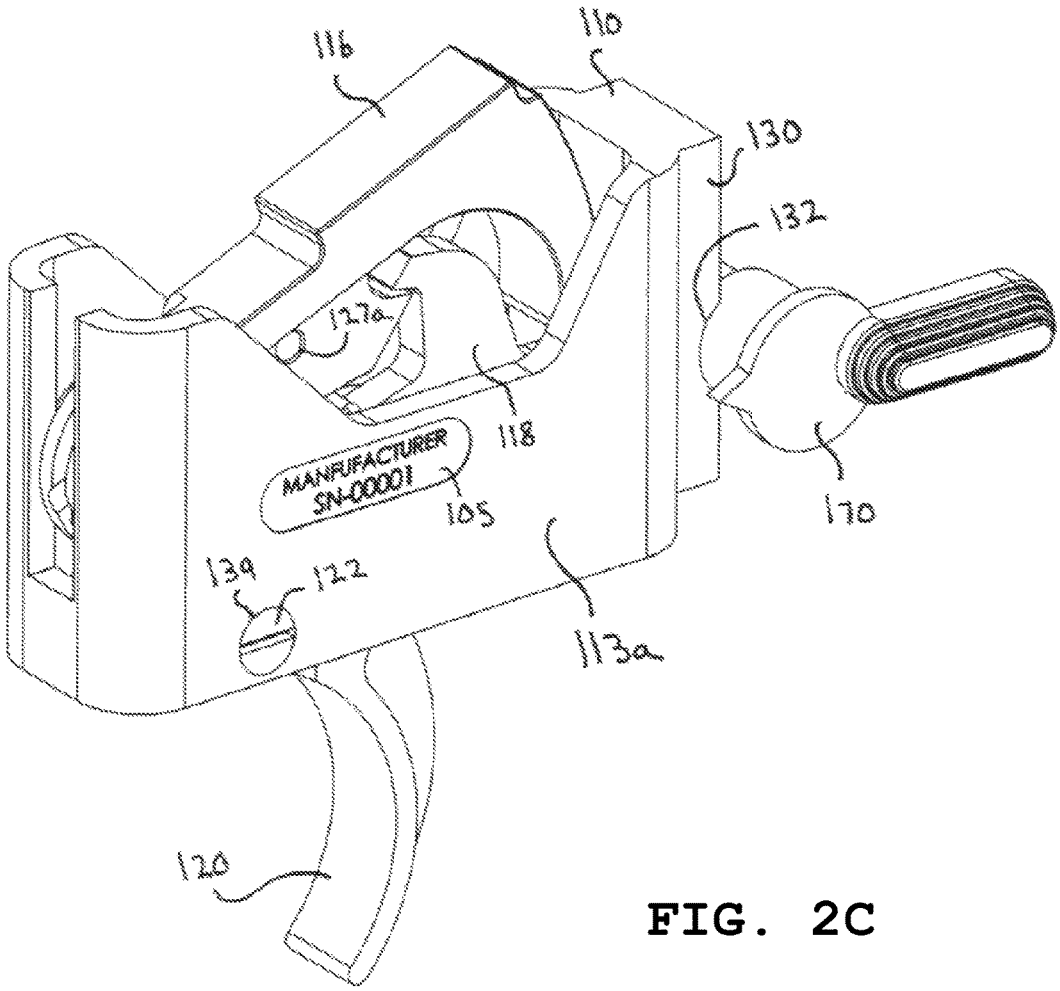
FIG. 2C is a left side view of the first design trigger carriage with safety lever.
Figure 2D:
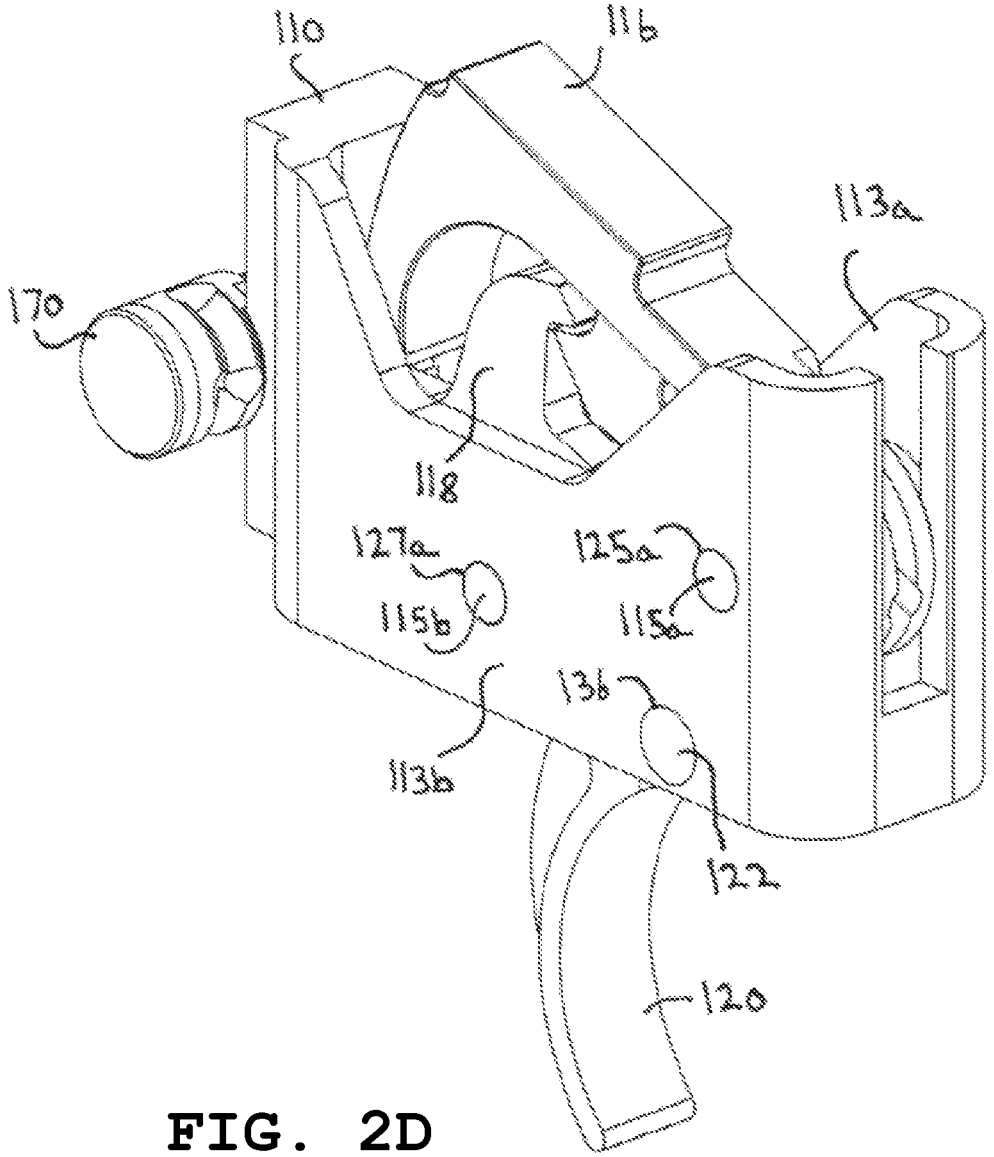
FIG. 2D is a right side view of the first design trigger carriage with safety lever.

As shown in FIG. 2C, in some implementations, the trigger 120 may be adjusted by rotating the adjustment screw 122. In some implementations, the adjustment screw 122 is rotatable between a first position and a second position. In this way, a user may select the pull force (e.g., 3.5 lbs or 5.5 lbs) required to initiate a discharge. In some implementations, the generally cylindrical body of the adjustment screw 122 may include a first groove 135*a* and a second groove 135*b* (collectively grooves 135) thereon (see, e.g., FIG. 3B). In some implementations, the first groove 135*a* and the second groove 135*b* are configured to receive a first end 121*a* and a second end 121*b*, respectively, of the trigger spring 121 (see, e.g., 3A). In some implementations, the grooves 135 are configured to act as a camming surface on the first end 121*a* and the second end 121*b* of the trigger spring 121. In this way, the torque exerted by the trigger spring 121 on the trigger 120 may be adjusted (e.g., increased or decreased). In some implementations, rotating the adjustment screw 122 between the first position and the second position causes the grooves 135 to cam the first end 121*a* and the second end 121*b* of the trigger spring 121 and thereby increase or decrease the pull force required to initiate a discharge using the trigger 120. In some implementations, the trigger 120 may include a groove 138 on the underside thereof near the nose 137 which provides clearance for the rotation of the adjustment screw 122 (see, e.g., FIG. 3A).

As shown in FIG. 2C, in some implementations, the housing module 112 includes an adjustment screw receiver for receiving the adjustment screw 122 and supporting the adjustment screw 122 by its ends. In some implementations, the adjustment screw receiver comprises a first adjustment screw receiver opening 136 on a right lateral side wall 113*b* of the housing module 112 and a first adjustment screw receiver opening 139 on the opposite left lateral side wall 113*a* of the housing module 112 (see, e.g., FIG. 5A). In some implementations, the adjustment screw 122 is held in place by the trigger spring 121 (see, e.g., FIG. 3A).

As shown in FIG. 1B, in some implementations, the frame 140 of the modular receiver system 100 may comprise a receiver assembly receiving area 142, an aperture 149, and a magazine well 144 configured to receive an ammunition feeding device.

As shown in FIG. 1B, the receiver assembly receiving area 142 comprises a cavity defined between a first lateral side wall 146*a* and a second lateral side wall 146*b* of the frame 140 that is large enough to house the receiver assembly 110. In some implementations, the receiving area 142 may be exposed by removing the AR-15® or AR15-type upper receiver group (not shown, but well known to those of ordinary skill in the art) from the frame 140. The modular receiver system 100 as a whole (i.e., the frame 140, safety selector 170, and receiver assembly 110) comprises the portion of an AR-15 type rifle known as the lower receiver. As previously mentioned, the model AR-15® rifle is used as a convenient and well known example in this disclosure and is not meant to limit the invention to the form factor of an AR-15® or AR-15 type rifle.

As shown in FIG. 1A, in some implementations, the left or second lateral side wall 146*b* of the frame 140 may include a window or aperture 149 through which the serial number 105 and/or other information appearing on the corresponding aligned portion of the exterior-facing surface of the left lateral side wall 113*a* of the housing module 112 can be visualized. In some implementations, the aperture 149 may include a pane of transparent material. In some implementations, the aperture 149 may not be covered with any material.

As shown in FIGS. 1D, 1E, 5C, 5D, and 5F, in some implementations, the trigger assembly receptacle 110 may have an extended lower shelf 134 may be used to provide sufficient internal space within the body, springs, and/or trigger components. In all instances, sufficient clearance in the housing 110 for the trigger 120 would be created by slot 133.

Figure 1G:
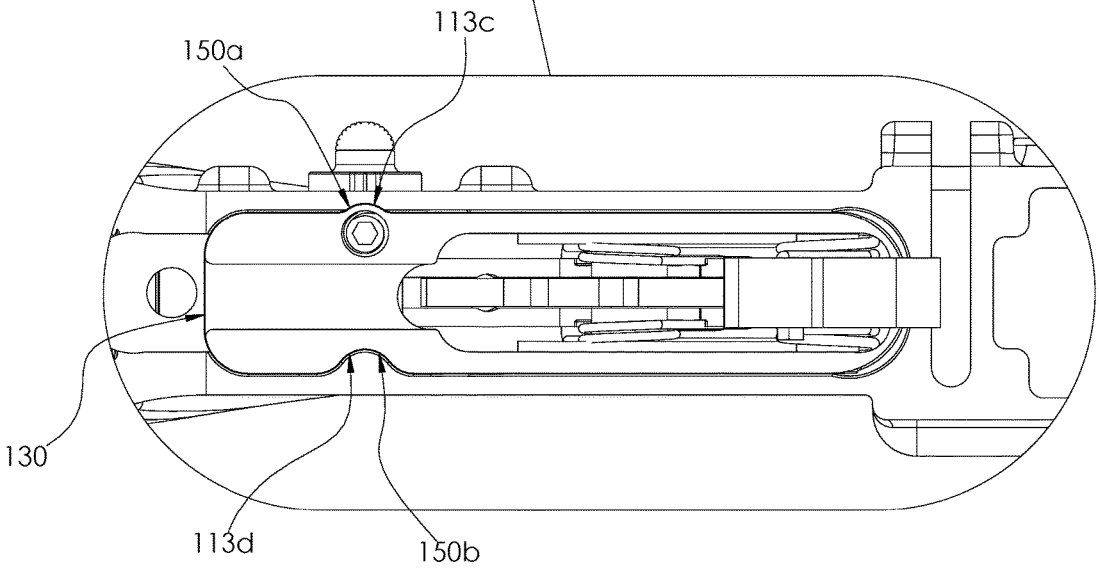

As shown in FIGS. 1B and 1G, in some implementations, proud surfaces 113*c* and 150*b* and their corresponding recessed surfaces 113*d* and 150*a* may be used to ensure fit, rigidity, and alignment. The same features may be used to ensure incompatibility of both the frame and trigger assembly group with other standard firearm platforms.

As shown in FIGS. 1A and 1B, in some implementations, the magazine well 144 of the frame 140 is located in front of the receiver assembly receiving area 142 and is configured (e.g., dimensioned) to receive an ammunition feeding device therein (not shown, but well known to those of ordinary skill in the art). In some implementations, interchangeable frames 140 may be used as part of the modular receiver system 100 to substitute one caliber of ammunition for another. In this way, the modular receiver system 100 may be configured to retain an ammunition feeding device (e.g., a magazine) configured to contain and feed the same caliber of ammunition as the upper receiver group that a user wants to use therewith. In some implementations, the magazine well 144 of a first frame 140 may be configured to receive and interface with a first ammunition feeding device configured to contain and feed a first caliber (e.g., 5.56×45 mm) of ammunition and the magazine well 144 of a second frame 140 may be configured to receive and interface with a second ammunition feeding device configured to contain and feed a second caliber (e.g., 7.62×51 mm) of ammunition.

As shown in FIG. 1B, in some implementations, the frame 140 includes a receiving bore 148 for receiving the safety selector 170 and supporting the safety selector 170 by its ends (e.g., the two support portions 178, 180 thereof).

As shown in FIG. 1A, in some implementations, the safety selector 170 is rotatably coupled to the receiver assembly 110 and the frame 140. In some implementations, the safety selector 170 comprises a shaft portion 172 with a selector member 174 at one end (see, e.g., FIG. 4A). In some implementations, the shaft portion 172 comprises a camming surface 176, two support portions 178, 180, and/or a safety selector position feature 182 (see, e.g., FIG. 4A).

In some implementations, the support portions 178, 180 act as supporting surfaces and support the safety selector 170 in the receiving bore 148 of the frame 140 (see, e.g., FIG. 1A). In some implementations, the two support portions 178, 180 may have the same diameter. In some implementations, the two support portions 178, 180 may not have the same diameter.

As shown in FIG. 4A, in some implementations, the camming surface 176 of the shaft portion 172 may be a trigger camming surface. In some implementations, the camming surface 176 may be configured to interface with the bore or groove 132 in the back wall 130 of the housing module 112. In this way, the camming surface 176 may be used to prevent the removal of the receiver assembly 110 from the receiving area 142 of the frame 140.

As shown in FIGS. 4A, 4B and 4C, in some implementations, the safety selector position feature 182 is located next to the support position 180 distal from the selector member 174. In some implementations, the safety selector position feature 182 includes two offset furrows 183*a* and 183*b* and is configured to engage with a spring loaded detent assembly 160, 161, and 162 housed in the lateral wall 113*c* of the trigger assembly receptacle. In some implementations, the safety selector position feature 182 may include a first furrow or guide section 183*a* and a second furrow or guide section 183*b*, and a first recess 184*a*, a second recess 184*b*, and a third recess 184*c* (collectively recesses 184) which act as detent engagement locations (see, e.g., FIG. 4C). In some implementations, the recesses 184 may act as indexing locations for the safety selector 170 and thereby hold the safety selector 170 in each selector position (e.g., "SAFE", "SEMI", etc.).

As shown in FIG. 2A, in some implementations, the first selector position or "SAFE" position may prevent the trigger 120 from being used to discharge the firearm. In some implementations, the spring loaded detent is engaged with the first recess 184*a* when the safety selector 170 is in the first selector position (see, e.g., FIG. 4C).

In some implementations, the second selector position or "SEMI" position may allow the trigger 120 to be pulled and for one round of ammunition to be fired until the trigger 120 is release and re-pressed. The principles of semi-automatic fire are well known to those of ordinary skill in the art. In some implementations, when the safety selector 170 is in the second selector position, the spring loaded detent is engaged with the first portion of the second recess 184*b* that is aligned with the first guide section 183*a* (see, e.g., FIG. 4C).

As shown in FIG. 1A, in some implementations, the third selector position removes the camming surface 176 from engagement with the bore or groove 132 on the back wall 130 of the housing module 112. In this way, the receiver assembly 110 may be removed from the receiving area 142 of the frame 140 and withdrawn through the channel 173 of the safety selector 170 (see, e.g., FIG. 1B). In some implementations, the spring loaded detent is engaged with the third recess 184*c* when the safety selector 170 is in the third selector position (see, e.g., FIG. 4B).

In some implementations, the safety selector 170 may be axially rotated between the "SAFE" position and the "SEMI" position using the same motion as would be employed with an AR-15/M16 type rifle.

In some implementations, the following steps may be used to remove the receiver assembly 110 from a frame 140 configured for use as part of the modular receiver system 100. Initially, the safety selector 170 is moved to the second selector position (not shown).

Then, the safety selector 170 is pressed from the right side of the frame 140 towards the left side of the frame 140. In this way, the spring loaded detent may be shifted from the first guide section 183*a* to the second guide section 183*b* via the second recess 184*b* of the safety selector position feature 182 (see, e.g., FIG. 4C).

Next, the safety selector 170 is axially rotated to the third selector "release" position thereby removing the camming surface 176 from engagement with the bore or groove 132 in the back wall 130 of the housing module 112 (see, e.g., FIG. 1A).

Figure 3C:
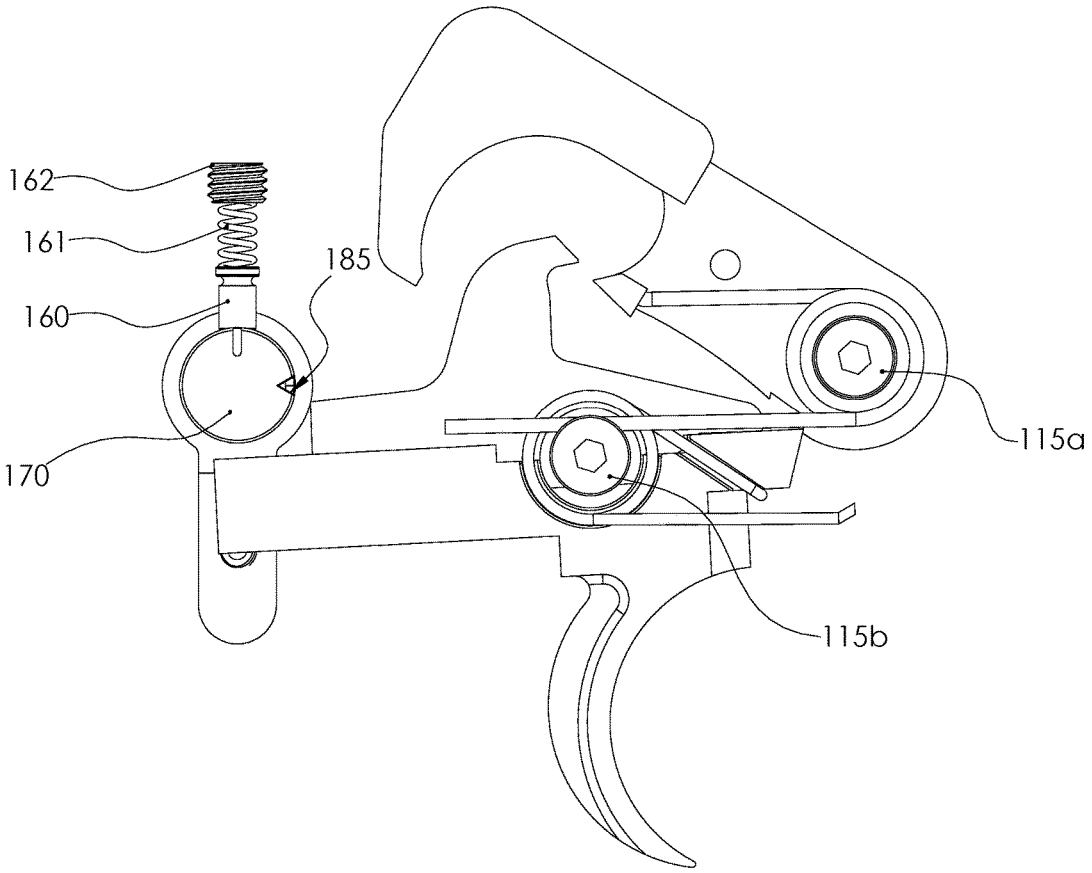
FIG. 3C is an isolated (right side) view of the fire control group and the selector switch group.

In some implementations, as shown in FIGS. 3C, 4A, and 4B, the detent 160 may be disengaged from the safety selector 170, by sliding along clearance surface 185, ensuring ease of disengagement of the safety selector 170.

Then, the receiver assembly 110 may be withdrawn from the receiver assembly receiving area 142 of the frame 140 and through the channel 173 of the safety selector 170 (see, e.g., FIG. 1B).

At this point, the user may clean the components of the modular receiver system 100, perform other maintenance, and/or re-install the receiver assembly 110 into a frame 140.

In some implementations, the following steps may be used to install the receiver assembly 110 into the receiver assembly receiving area 142 of a frame 140 configured for use as part of the modular receiver system 100. Initially, the safety selector 170 is moved to the third selector position (see, e.g., FIG. 1B).

Then, the receiver assembly 110 is inserted into the receiving area 172 of the frame 140 so that the bore or groove 132 is in axial alignment with receiving bore 148 (see, e.g., FIG. 1A).

Next, the safety selector 170 is axially rotated to the second selector position thereby placing the camming surface 176 into engagement with the bore or groove 132 in the back wall 130 of the housing module 112 (see, e.g., FIG. 2A).

Then, the safety selector 170 is pressed from the left side of the frame 140 towards the right side of the frame 140. In this way, the spring loaded detent may be shifted from the second guide section 183*b* to the first guide section 183*a* via the second recess 184*b* of the safety selector position feature 182 (see, e.g., FIG. 4C).

At this point, the receiver assembly 110 has been locked into the frame 140 and the modular receiver system 100 has been assembled.

As shown in FIG. 1A, in some implementations, an additional spring loaded detent 163 may be used in conjunction with a groove in the frame 150 (left side), to ensure the selector switch is not rotated inadvertently into the "release" (removal) position. The groove 150 would be sufficiently deep to prevent the detent from creating excess pressure when switching between "safe" and "fire" positions. The groove 150 would be sufficiently short in arc length to end around the 90-degree or "fire" position, in order to prevent inadvertent "release" or removal of the safety selector.

Except as noted herein, the safety selector 170 is similar to the safety selector used as part of the firing mechanism of the COLT® model AR-15® rifle and/or other AR-15 type rifles. However, it is to be understood that the safety selector 170 shown is only for the purposes of example and is not meant to limit the invention to the safety selector of an AR15/M16 type rifle or the safety selector 180 shown in the figures.

The receiver assembly 110 may be considered the firearm (i.e., the controlled part) by the Bureau of Alcohol, Tobacco, Firearms and Explosives (BATFE) since the fire control group (e.g., the hammer 116, hammer spring 117, disconnector 118, trigger 120, and trigger spring 121) is contained within a housing module 112 having the serial number thereon 105.

It should be noted that no tools are required to assemble or disassemble the implementations of the modular receiver system 100 in or out of the frame or lower receiver. Tools may be required for removing pins 115*a*, 115*b*, or 122 in some implementations.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

I claim:

1. A firearm comprising:

a frame defining a trigger assembly receptacle between opposed sidewalls;

a trigger assembly within a housing module, the housing module configured to be received in the trigger assembly receptacle, the housing module including pivot pins;

the housing module defining pin apertures adapted to receive the pivot pins; wherein the opposed sidewalls do not define corresponding pin apertures and do not receive the pivot pins;

the trigger assembly having a pivoting safety selector;

the housing module comprising an aperture to receive a spring loaded detent assembly adapted to engage the safety selector in a stable rotational position;

wherein the trigger assembly utilizes the safety selector and spring loaded detent assembly to secure the trigger assembly into the frame to enable tool-less assembly and disassembly of the trigger assembly and housing module from the frame;

wherein the opposed sidewalls define a safety selector aperture adapted to receive the safety selector; and proud and recessed surfaces on the trigger assembly receptacle such that the trigger assembly receptacle can only receive a housing module having corresponding proud and recessed surfaces.

* * * * *